US010800641B2

(12) United States Patent
Schmalzl et al.

(10) Patent No.: US 10,800,641 B2
(45) Date of Patent: Oct. 13, 2020

(54) OUTRIGGER COMPRISING AN APPARATUS FOR REDUCING VIBRATIONS

(71) Applicant: Jungheinrich Aktiengesellschaft, Hamburg (DE)

(72) Inventors: Jürgen Schmalzl, Haimhausen (DE); Hubert Bibernell, Landshut (DE); Carsten Schöttke, Moosburg (DE); Ernst-Peter Magens, Ammersbek (DE)

(73) Assignee: JUNGHEINRICH AKTIENGESELLSCHAFT, Hamburg (DE)

( * ) Notice: Subject to any disclaimer, the term of this patent is extended or adjusted under 35 U.S.C. 154(b) by 383 days.

(21) Appl. No.: 15/633,893

(22) Filed: Jun. 27, 2017

(65) Prior Publication Data

US 2017/0369293 A1 Dec. 28, 2017

(30) Foreign Application Priority Data

Jun. 28, 2016 (DE) ..... 10 2016 211 603

(51) Int. Cl.

| | |
|---|---|
| ***B66F 9/075*** | (2006.01) |
| ***B66F 9/14*** | (2006.01) |
| ***B66F 9/07*** | (2006.01) |

(52) U.S. Cl.

CPC ..... *B66F 9/07559* (2013.01); *B66F 9/07* (2013.01); *B66F 9/0759* (2013.01); *B66F 9/148* (2013.01)

(58) Field of Classification Search

CPC ..... B66F 9/07559; B66F 9/0759; B66F 9/07
See application file for complete search history.

(56) References Cited

U.S. PATENT DOCUMENTS

| | | |
|---|---|---|
| 3,561,628 A | 2/1971 | Melin |
| 3,937,346 A | 2/1976 | Van |

(Continued)

FOREIGN PATENT DOCUMENTS

| | | |
|---|---|---|
| CN | 105668462 | 6/2016 |
| DE | 2512521 | 9/1976 |

(Continued)

OTHER PUBLICATIONS

Machine Translation of DE 10 2008 020 595.*
U.S. Appl. No. 15/631,096 , "Non-Final Office Action", dated Nov. 16, 2018, 11 pages.
U.S. Appl. No. 15/498,515 , "Supplemental Notice of Allowance", dated Mar. 20, 2019, 2 pages.

(Continued)

*Primary Examiner* — Diem M Tran
(74) *Attorney, Agent, or Firm* — Kilpatrick Townsend & Stockton LLP

(57) ABSTRACT

The invention relates to an industrial truck comprising a vehicle body (6); a mast (8) that extends substantially vertically and is rigidly connected to the vehicle body (6) or hinged to the vehicle body (6), the mast (8) being associated with a load-carrying apparatus such that said apparatus can be moved upwards and downwards on said mast, which load-carrying apparatus comprises at least one load-receiving means for receiving a load that is to be transported; and an outrigger (9), the longitudinal axis (L) of which extends between a first fastening point (9*a*) on the vehicle body (6) and a second fastening point (9*b*) on the mast (8), the second fastening point (9*b*) being associated with a vertically upper side of the mast (8). In this case, the outrigger (9) is associated with an apparatus for reducing vibrations (9*d*) which is designed to reduce vibrations acting in the direction of the longitudinal axis (L) of the outrigger (9).

11 Claims, 4 Drawing Sheets

(56) References Cited

U.S. PATENT DOCUMENTS

| | | | |
|---|---|---|---|
| 4,218,170 | A | 8/1980 | Goodacre |
| 4,439,102 | A | 3/1984 | Allen |
| 5,657,834 | A | 8/1997 | Plaugher et al. |
| 7,736,115 | B2 | 6/2010 | Lambert |
| 7,980,807 | B2 | 7/2011 | Schoenauer |
| 8,078,368 | B2 | 12/2011 | Hall |
| 8,944,744 | B2 | 2/2015 | Kleeberger et al. |
| 9,403,667 | B2 | 8/2016 | Mccabe et al. |
| 9,890,025 | B2 | 2/2018 | Colantonio |
| 10,046,812 | B2 | 8/2018 | Schmalzl et al. |
| 10,266,379 | B2 | 4/2019 | Schottke et al. |
| 10,308,489 | B2 | 6/2019 | Magens et al. |
| 10,329,131 | B2 | 6/2019 | Schmalzl et al. |
| 10,427,924 | B2 | 10/2019 | Schöttke et al. |
| 2005/0156391 | A1 | 7/2005 | Krenzin et al. |
| 2006/0182588 | A1 | 8/2006 | Beckett et al. |
| 2007/0116548 | A1 | 5/2007 | Cooper |
| 2009/0312875 | A1 | 12/2009 | Lehtonen et al. |
| 2009/0314582 | A1 | 12/2009 | Meijer |
| 2015/0040481 | A1 | 2/2015 | Stover et al. |
| 2016/0214659 | A1 | 7/2016 | Schmalzl et al. |
| 2017/0313563 | A1 | 11/2017 | Magens et al. |
| 2017/0313565 | A1 | 11/2017 | Magens et al. |
| 2017/0327362 | A1 | 11/2017 | Schmalzl et al. |
| 2017/0349418 | A1 | 12/2017 | Schmalzl et al. |
| 2017/0369294 | A1 | 12/2017 | Magens et al. |

FOREIGN PATENT DOCUMENTS

| | | | | |
|---|---|---|---|---|
| DE | 8806324 | | 8/1988 | |
| DE | 3925668 | | 2/1991 | |
| DE | 4016497 | | 11/1991 | |
| DE | 4019075 | | 12/1991 | |
| DE | 10054789 | | 5/2002 | |
| DE | 10055751 | | 5/2002 | |
| DE | 10240851 | | 5/2003 | |
| DE | 102004002188 | | 8/2005 | |
| DE | 102004045698 | | 3/2006 | |
| DE | 602004001979 | | 3/2007 | |
| DE | 102008020592 | | 10/2009 | |
| DE | 102008020595 | | 10/2009 | |
| DE | 102013014094 | | 3/2015 | |
| DE | 102013113428 | | 6/2015 | |
| DE | 202015004375 | | 4/2016 | |
| DE | 102015201098 | | 7/2016 | |
| EP | 2368832 | A1 * | 9/2011 | ..... B66F 9/07545 |
| EP | 2368832 | | 6/2013 | |
| EP | 2881358 | | 6/2015 | |
| FR | 2243144 | | 4/1975 | |
| GB | 2379434 | | 9/2004 | |
| JP | H04130294 | | 11/1992 | |
| JP | 2004277068 | | 10/2004 | |
| JP | 2006160406 | | 6/2006 | |

OTHER PUBLICATIONS

U.S. Appl. No. 15/592,236 , "Notice of Allowance", dated Mar. 6, 2019, 7 pages.
U.S. Appl. No. 15/631,096 , "Notice of Allowance", dated Mar. 12, 2019, 5 pages.
U.S. Appl. No. 15/592,236, "Supplemental Notice of Allowability", dated May 13, 2019, 3 pages.
U.S. Appl. No. 15/498,514 , "Non-Final Office Action", dated Sep. 4, 2018, 13 pages.
U.S. Appl. No. 15/498,515 , "Non-Final Office Action", dated Aug. 31, 2018, 12 pages.
U.S. Appl. No. 15/592,236 , "Non-Final Office Action", dated Aug. 10, 2018, 11 pages.
German Application No. 10 2016 207 526.8, German Search Report dated Apr. 12, 2017.
German Application No. 10 2016 211 390.9, German Search Report dated May 18, 2017.
German Application No. 10 2016 208 205.1, German Search Report dated Apr. 28, 2017.
German Application No. 10 2016 209 893.4, German Search Report dated May 15, 2017.
German Application No. 10 2016 211 603.7, German Search Report dated May 29, 2017.
German Application No. 10 2016 207 523.3, German Search Report dated Apr. 11, 2017.
European Patent Application No. 17168717.1, Extended European Search Report dated Sep. 29, 2017.
European Patent Application No. 17168817.9, Extended European Search Report dated Oct. 17, 2017.
European Patent Application No. 17170608.8, Extended European Search Report dated Oct. 20, 2017.
European Patent Application No. 17173979.0, Extended European Search Report dated Oct. 20, 2017.
European Patent Application No. 17177385.6, Extended European Search Report dated Nov. 22, 2017.
European Patent Application No. 17178081.0, Extended European Search Report dated Nov. 24, 2017.
U.S. Appl. No. 15/498,514, "Final Office Action", dated Feb. 11, 2019, 11 pages.
U.S. Appl. No. 15/498,515, "Notice of Allowance", dated Feb. 13, 2019, 5 pages.
U.S. Appl. No. 15/610,753 , "Non Final Office Action", dated Dec. 28, 2018, 7 pages.
U.S. Appl. No. 15/498,514, "Notice of Allowance", dated Jun. 19, 2019, 7 pages.
U.S. Appl. No. 15/610,753, "Notice of Allowance", dated Jun. 25, 2019, 5 pages.
U.S. Appl. No. 15/498,514, "Supplemental Notice of Allowability", dated Aug. 16, 2019, 2 pages.

* cited by examiner

OUTRIGGER COMPRISING AN APPARATUS FOR REDUCING VIBRATIONS

CROSS REFERENCE TO RELATED APPLICATION

This application claims priority to German Patent Application No. 10 2016 211 603.7, filed in Germany on Jun. 28, 2016, the entire contents of which are hereby incorporated herein by this reference.

The invention relates to an industrial truck comprising a vehicle body, a mast that extends substantially vertically and is rigidly connected to the vehicle body or is hinged to the vehicle body, the mast being associated with a load-carrying apparatus such that said apparatus can be moved upwards and downwards on said mast, which load-carrying apparatus comprises at least one load-receiving means for receiving a load that is to be transported, and an outrigger, the longitudinal axis of which extends between a first fastening point on the vehicle body and a second fastening point on the mast, the second fastening point being associated with a vertically upper side of the mast.

Outriggers of this kind for the mast are used in particular in high-bay stacker trucks, more particularly in tri-lateral sideloaders for order picking, in which load-carrying fork arms can be oriented or directed transversely to the straightforward direction of travel (main direction of travel) of the industrial truck for lateral push operations. Sideloaders of this kind designed as high-bay stacker trucks make it possible to combine stacking and unstacking of entire palettes and picking individual articles from high bays without difficulty. High-bay stacker trucks of the type mentioned include those in which the cab itself is also arranged on the mast so as to be movable upwards and downwards by means of a cab carrier.

In principle, however, the present invention can also be used in differently designed industrial trucks, in which the mast can either be rigidly connected to the vehicle body or can be pivotable out of the vertical position by a predetermined angle relative to the vehicle body.

In the industrial trucks mentioned, the purpose of the outrigger is to absorb some of the forces acting on the mast, inter alia due to the load carried by the load-receiving means. Since the mast itself, as mentioned, is substantially vertically connected to the vehicle body, and the force acting on the mast due to the load carried exerts a torque about the connection point between the mast and the vehicle body that is directed forwards, the outrigger in particular absorbs force components in the straightforward direction of travel of the industrial truck. These forces may, as mentioned, be caused by the load carried, but may also be caused by acceleration and braking forces acting on the mast and on the load carried. The effect of the outrigger can therefore essentially be summarised as rigidifying the connection between the mast and the vehicle body in the straightforward and backward direction of travel of the industrial truck, and counteracting torsion of the mast as a result of torsional moments during stacking.

A typical task for the above-described tri-lateral sideloaders for order picking is to put a pallet comprising a load located thereon in a bay for storage, the vehicle being located in a narrow aisle between the bays of a high-bay warehouse and the pallet being carried by the load-receiving means. Various operations are required for this, such as movement of the industrial truck on a surface, extension of the mast to a height suitable for storage placement, optionally pivoting of the load-receiving means, and lateral extension of the load-receiving means.

It is a known problem that, in industrial trucks, vibrations can occur in the mast, which vibrations include both transverse vibrations having lateral vibrating components, i.e. vibrating components that are directed transversely to the straightforward direction of travel of the industrial truck and are normally horizontal, and also vibrations that are directed in the straightforward direction of travel of the industrial truck and are mainly manifested in oscillation of the mast about the fastening point thereof to the industrial truck. Vibrations of this kind occur, for example, when travelling over an uneven surface and, in high-bay tri-lateral sideloaders for picking orders, are often more severe the higher the driver's platform and the apparatuses on the front thereof are raised on the mast and the greater the load is that is carried by the load-receiving means.

Such vibrational movements, including the transverse vibrations of the mast relative to the vehicle body, can be unpleasant for an operator located on the driver's platform and make the placement of pallets into bays and their retrieval from bays difficult or even sometimes impossible, such that the operator can usually only begin a placement or retrieval procedure safely when the vibrations have subsided once the industrial truck is stationary. Alternatively, the operator could in principle drive the industrial truck at a reduced speed when travelling over uneven ground in order to largely prevent excitation of vibrations. Both of these would, however, reduce productivity when working with the industrial truck.

EP 2 368 832 B1 discloses an industrial truck of the type mentioned at the outset, designed as a man-up vehicle, in which measures for reducing vibrations have already been taken. These measures consist in attaching an assembly, which is referred to as a load-receiving portion, can move up and down on the mast and comprises the interconnected cab and load-supporting apparatus, to the mast such that said entire assembly can carry out movements relative to the mast that have a lateral, i.e. usually horizontal, movement component, and that are transverse to the straightforward direction of travel of the industrial truck, a separate degree of freedom of movement for the assembly that is not intended for the planned operation of the industrial truck being established in this case. The known industrial truck comprises means for damping or preventing vibrations in the relative position between the load-receiving portion and the mast, i.e. between the driver's platform (cab) and the mast. In this case, these means can be active, semi-active and/or passive vibration-damping means, which are suitable for generating a force or a torque between the mast and the load-receiving portion, which force or torque has a component along the separate degree of freedom of movement that is not intended for the planned operation of the industrial truck.

For reducing vibrations, EP 2 368 832 B1 proposes, inter alia, damping elements and springs which counteract deflection of the mast and the assembly (referred to as the load-receiving portion) along the separate degree of freedom of movement. A disadvantage of this known solution is that it involves a relatively large amount of installation effort in order to attach the entire assembly, consisting of the driver's platform and all the load-receiving components that can move vertically on the mast together therewith, to the mast while establishing the separate degree of freedom of movement that is not intended for the planned operation of the industrial truck. Retrofitting a relevant industrial truck with said known vibration-reducing measures would also be complicated and laborious. Moreover, the apparatus known from EP 2 368 832 B1 is suitable only to a limited extent for damping vibrations occurring in the main direction of movement of the industrial truck.

Furthermore, DE 40 19 075 A1 discloses an industrial truck comprising a mast that is associated with an arrangement in the region of the lower part of the mast that counteracts vibrations, in conjunction with an apparatus for horizontally moving said mast. However, this also has a relatively laborious design and is not suitable for stackers for order picking since the fact that the arrangement for counteracting vibrations is arranged in the lower region of the mast results in disadvantageous leverage ratios with respect to the extendable driver's platform.

The object of the present invention is therefore to provide a generic industrial truck in which a reduction in vibrations of the mast relative to the vehicle body, in particular in the main direction of movement of the industrial truck and transversely thereto, can be achieved using simple technical means.

For this purpose, in the industrial truck according to the invention, the outrigger is associated with an apparatus for reducing vibrations which is designed to reduce vibrations acting in the direction of the longitudinal axis of the outrigger.

Since, as mentioned, the outrigger in particular absorbs vibrating components in the main direction of movement of the industrial truck, the vibration-reducing apparatus associated with the outrigger makes it possible to achieve damping of vibrations of the mast directed in precisely that direction, with little structural complexity. In this case, it is possible in particular to optimally adjust the degree of the above-mentioned rigidification of the connection between the mast and the vehicle body by providing a suitable apparatus for reducing vibrations.

In a development of the invention, a plurality of outriggers may be provided, which are each associated with an apparatus for reducing vibrations and which each extend between a first fastening point on the vehicle body and a second fastening point on the mast. This development in addition makes it possible to achieve improved damping of torsional vibrations of the mast about the vertical axis thereof and/or improved damping of vibrations that act asymmetrically on the mast. In particular, in this case, at least two of the first fastening points can be arranged on opposing sides of the vehicle body in the width direction of the industrial truck.

The invention is not limited to arrangements in which the outriggers extend strictly in the longitudinal direction of the industrial truck, but rather the two fastening points of at least one outrigger can be arranged on opposing sides on the vehicle body and the mast in the width direction of the industrial truck. Since at least one outrigger is thus arranged diagonally with respect to the longitudinal direction and the width direction of the industrial truck, said outrigger can damp transverse vibrations of the mast to a greater extent, since said transverse vibrations lead to tensile and compressive forces along the longitudinal axis of the outrigger.

In one embodiment, the apparatus or at least one of the apparatuses for reducing vibrations can be designed as a shock absorber, for example can be formed as a hydraulic shock absorber or can comprise a helical spring. However, more complicated or multicomponent apparatuses for reducing vibrations are also conceivable. In particular, the apparatus or at least one of the apparatuses for reducing vibrations can comprise a controller that is designed to adapt the vibration-reducing properties of the apparatus or at least one of the apparatuses for reducing vibrations on the basis of operating data of the industrial truck. In such a case, the damper may be a controllable hydraulic damper for example, while the operating data of the industrial truck could, for example, be the loading of the vehicle or the load carried by the load-receiving means, the current speed of the industrial truck, the current extended height of the mast, and the like.

In one embodiment, the outrigger or at least one of the outriggers can be designed as a rigid rod at least in portions. The rigid design of the outrigger makes it possible for forces to be absorbed both in the forwards and in the backwards direction of the industrial truck while, for example, a tensioned wire rope or the like merely makes it possible for forces to be absorbed in one direction.

Furthermore, the first fastening point or at least one of the first fastening points can be associated with a counterweight of the industrial truck. This ensures optimal transfer of acting forces from the mast to the vehicle body.

The mast of an industrial truck according to the invention can be designed as a mast that is constructed of multiple parts so as to be telescopically extendable, the second fastening point of the outrigger or the second fastening points of all the outriggers preferably being assigned to the lowest telescopic stage.

Furthermore, at least one further outrigger can be provided in the industrial truck according to the invention, the longitudinal axis of which outrigger extends between a first fastening point on the vehicle body and a second fastening point on the mast, the second fastening point being associated with a vertically upper side of the mast, the at least one further outrigger not being associated with any apparatus for reducing vibrations. This at least one further outrigger without an apparatus for reducing vibrations can, for example, be advantageously combined with the above-mentioned diagonally arranged outriggers comprising apparatuses for reducing vibrations, if the further outrigger is arranged in parallel with the longitudinal direction of the vehicle. Damping of transverse vibrations of the mast can thus be achieved without the rigidity of the connection between the mast and the vehicle body in the longitudinal direction of the vehicle being substantially influenced.

In particular, as already mentioned above, the mast can be associated with a cab carrier that is movable in the vertical direction, and the industrial truck can be designed as a tri-lateral sideloader comprising pivotable load-receiving means.

Further features and advantages will become apparent from the following description when considered in conjunction with the accompanying figures in which, in detail:

FIG. 1 is a side view of an embodiment of an industrial truck according to the invention, specifically a high-bay stacker truck, which is designed as a tri-lateral sideloader.

Figure 1:
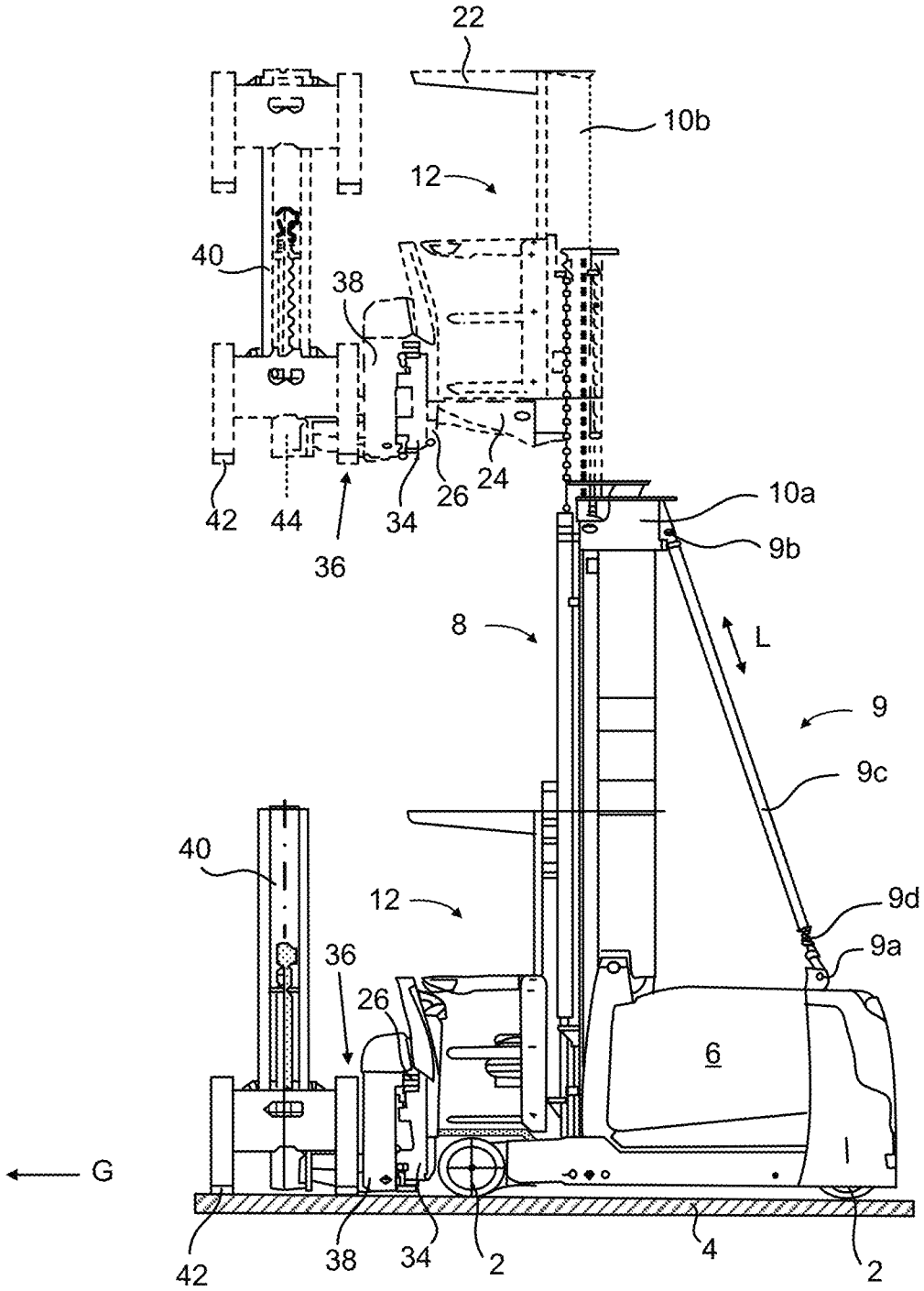
FIG. 1 is a side view of an embodiment of an industrial truck according to the invention that is designed as a tri-lateral high-bay stacker.

The industrial truck comprises a vehicle body 6 that stands on the ground 4 by means of wheels 2, and a mast 8 that is vertically fastened to the vehicle body 6. The mast 8 is designed as a multi-stage telescopic mast, the lowest telescopic stage 10*a* additionally being connected to the vehicle body 6 via an outrigger 9. For this purpose, the outrigger 9 is connected to the vehicle body 6 at a first fastening point 9*a* and to the mast 8 at a second fastening point 9*b*, and the longitudinal axis L of said outrigger extends between the two fastening points 9*a* and 9*b*. The outrigger 9 comprises a rigid rod portion 9*c* and, in addition, an apparatus for reducing vibrations 9*d*, which will be explained in greater detail in the description of FIG. 2.

At the furthest extendable telescopic stage 10*b* of the mast 8, a cab 12 is attached such that it can move vertically by means of a cab carrier 24 as a support structure. The cab 12 is designed as a lifting driver's cabin, which has a frame comprising a cabin floor, back wall, side walls and driver overheard guard 22. In the front of the cab 12 in the main direction of movement or straightforward direction of travel G of the industrial truck, a lateral push frame guide 26 is fastened to the cab support 24, which has retaining rails for the lateral push frame 34, which can move longitudinally therein.

The lateral push frame guide 26 allows for a laterally horizontal movement of the lateral push frame 34 in a plane transverse to the straightforward direction of travel G of the industrial truck. A load-carrying apparatus 36, which is known per se, is arranged on the lateral push frame 34 so as to be laterally movable, transversely to the straightforward direction of travel G of the industrial truck. Said apparatus comprises a pivoting pusher 38 that is movable on the lateral push frame 34, having an additional mast 40 arranged on the front thereof, on which mast a load-carrying fork 42 having a fork support arrangement is vertically movable as load-receiving means. The additional mast 40 can be pivoted together with the load-carrying fork 42 about the vertical axis 44 between the position shown in FIG. 1, in which the load-carrying fork 42 is oriented laterally, and a position in which the load-carrying fork 42 is oriented in an opposite lateral position.

Figure 2:
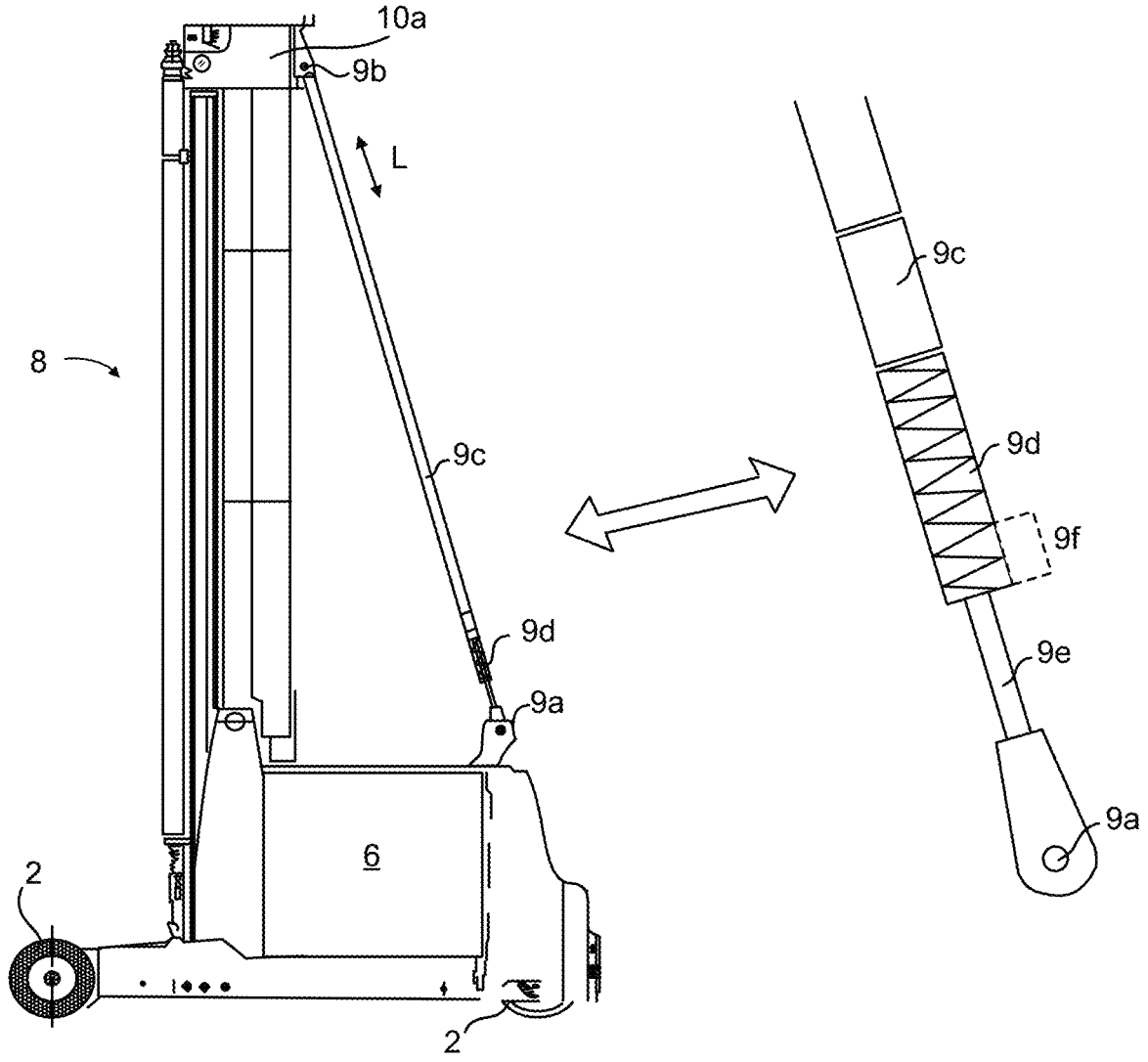
FIG. 2 is a simplified side view of the embodiment from FIG. 1, the outrigger being highlighted.

FIG. 2 is a simplified view, showing merely the wheels 2, the vehicle body 6, the lowest telescopic stage 10*a* of the mast 8 and the outrigger 9 of the industrial truck from FIG. 1, and in particular an enlarged view of a portion of the outrigger 9 that comprises the first fastening point 9*a* and the apparatus for reducing vibrations 9*d*.

It can be seen from FIG. 2 that the first fastening point 9*a* is located at the rear end of the vehicle body 6, in the region of the counterweight, while the second fastening point 9*b* is arranged at the upper end of the lowest telescopic stage 10*a* of the mast 8. This arrangement of the two fastening points 9*a* and 9*b* achieves optimal support of the mast 8 by the outrigger 9, since the lever arms for transferring forces in the straightforward direction of travel of the vehicle are thus optimally selected.

The outrigger 9 thus braces the mast 8 against forces that act in or counter to the straightforward direction of travel G of the industrial truck. Forces of this kind result from torques that are exerted by loads carried by the load-carrying means 42 at a distance from the mast in the G direction, but also from acceleration and/or braking of the industrial truck.

In order to reduce the vibrations in the mast 8 that are triggered by forces and torques of this kind, the outrigger 9 is associated with the above-mentioned apparatus for reducing vibrations 9*d*, between the rigid rod portion 9*c* and the first fastening point 9*a*, which apparatus is formed as a simple helical screw in the example shown. The apparatus for reducing vibrations 9*d* may comprise an optional controller 9*f*. This helical spring reduces a possible change in length of the outrigger 9 that is also made possible by a telescopic system. For this purpose, a second rod portion 9*e* can be inserted into and extended out of the end portion 9*f* of the rigid rod portion 9*c*, which end portion is formed as a hollow rod, one end of the helical spring being associated with the rigid rod portion 9*c* and the other end being associated with the second rod portion 9*e*. Since, when the outrigger 9 is static, the second rod portion 9*e* is neither completely inserted into the hollow end portion 9*f* nor completely extended out of said hollow end portion, the helical spring can be subjected both to compression and to tension and thus damp vibrations in these two directions. Arrangements comprising two pretensioned compression springs are also conceivable however, which springs each act in opposing directions on the rigid rod portion 9*c* and the second rod portion 9*e*.

Suitably selecting the spring rate of the helical spring makes it possible to appropriately select the damping parameters for the apparatus for reducing vibrations 9*d*, it also being possible to implement progressive damping properties for example by using springs having a spring rate that is dependent on the spring excursion thereof. Moreover, it would also be conceivable to use controlled apparatuses for reducing vibrations, in which the current damping parameters are made dependent on drive parameters of the industrial truck, such as the current speed or the useful load of the vehicle.

Figure 3:
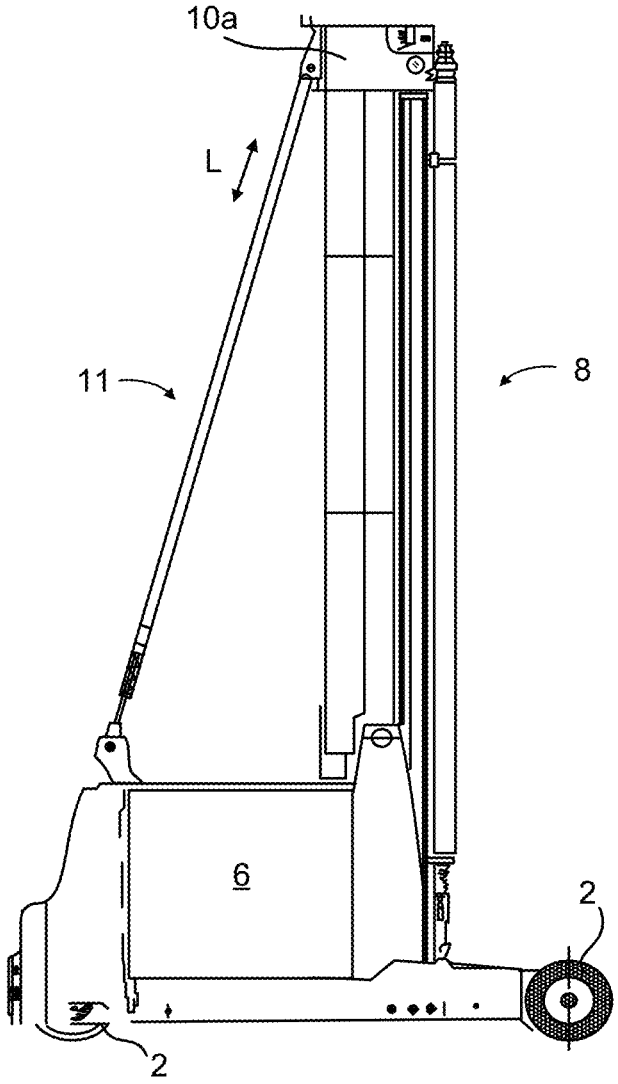
FIG. 3 is a simplified side view of the embodiment from FIG. 1, an additional outrigger being highlighted.

It should furthermore be noted that a plurality of outriggers can be arranged side-by-side at respective first fastening points 9*a* in the direction transverse to the straightforward direction of travel G of the industrial truck, i.e. in the width direction of the vehicle, for example one on each wide end of the vehicle body 6 in each case, and extend accordingly to respective second fastening points 9*b*. FIG. 3 is a simplified view, showing merely the wheels 2, the vehicle body 6, the lowest telescopic stage 10*a* of the mast 8, and an additional outrigger 11 of the industrial truck from FIG. 1. Since each one of this plurality of outriggers comprises an apparatus for reducing vibrations, torsion of the mast 8, caused by lateral ejection of the load for example, can also be damped to some extent.

Figure 4:
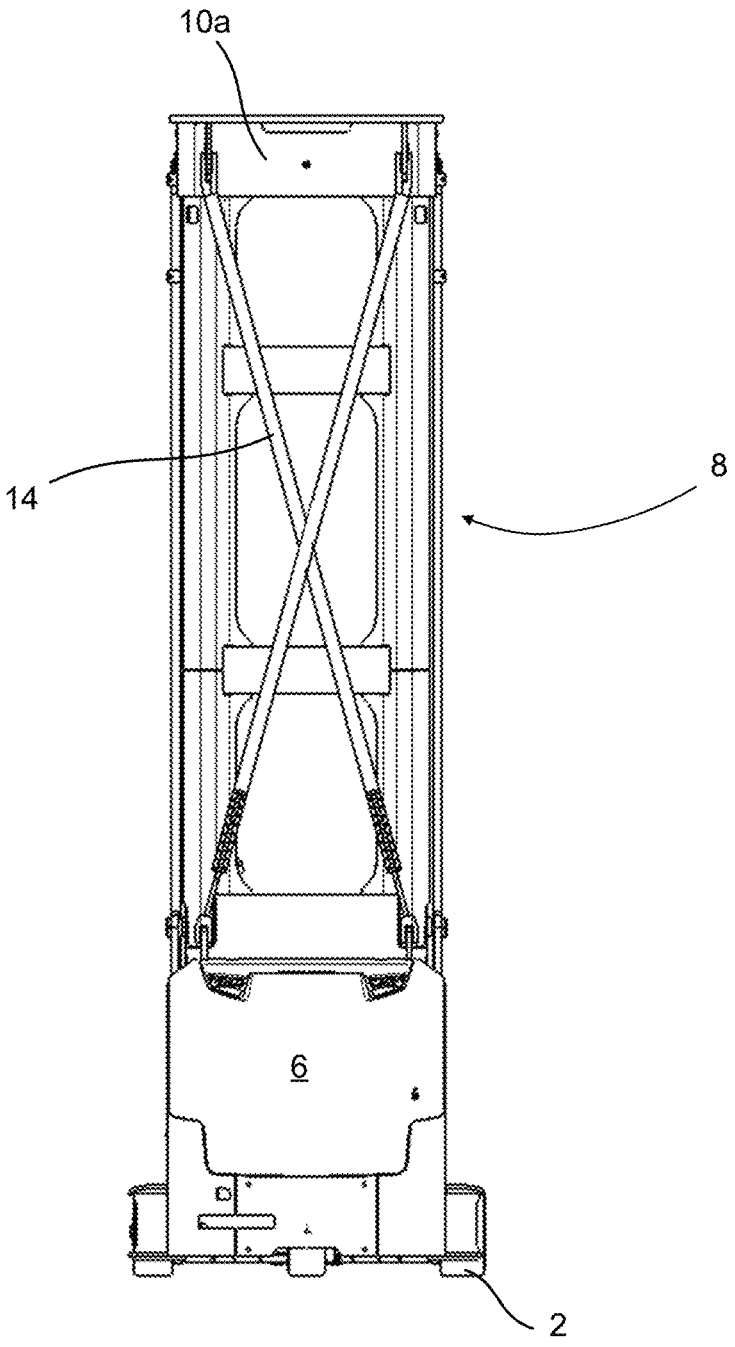
FIG. 4 is a rear view of the embodiment from FIG. 1, a diagonal outrigger being highlighted.

It should furthermore be noted that at, least one outrigger can be arranged diagonally with respect to the longitudinal direction and the width direction of the industrial truck. FIG. 4 is a rear view of the industrial truck from FIG. 1, showing merely the wheels 2, the vehicle body 6, the lowest telescopic stage 10*a* of the mast 8, and at least one diagonal outrigger 14.

The invention claimed is:

1. An industrial truck comprising:

a vehicle body;

a mast that extends substantially vertically and is rigidly connected to the vehicle body or hinged to the vehicle body, the mast being associated with a load-carrying apparatus such that said load-carrying apparatus can be moved upwards and downwards on said mast, wherein the load-carrying apparatus comprises at least one load-receiving means for receiving a load that is to be transported;

an outrigger, wherein a longitudinal axis of the outrigger extends between a first fastening point on the vehicle body and a second fastening point on the mast, the second fastening point being associated with a vertically upper side of the mast, the first fastening point and the second fastening point being arranged on opposing sides of the vehicle body and the mast in a width direction of the vehicle body;

wherein the outrigger is associated with an apparatus for reducing vibrations which is designed as a shock absorber to reduce vibrations acting in the direction of the longitudinal axis of the outrigger, wherein the longitudinal axis of the outrigger is arranged diagonally with respect to a longitudinal direction of the vehicle body, wherein the diagonally-arranged outrigger can damp transverse vibrations of the mast.

2. The industrial truck according to claim 1, wherein an additional outrigger is provided, wherein the additional outrigger is associated with an additional apparatus for reducing vibrations, wherein a longitudinal axis of the additional, outrigger extends between a third fastening point on the vehicle body and a fourth fastening, point on the mast.

3. The industrial truck according to claim 2, wherein the first and third fastening points are arranged on opposing sides of the vehicle body in the width direction of the vehicle body.

4. The industrial truck according to claim 1, wherein the shock absorber comprises one of a hydraulic shock absorber or a helical spring.

5. The industrial truck according to claim 1, wherein an additional outrigger is provided, wherein the additional outrigger is associated with an additional apparatus for reducing vibrations, wherein the additional apparatus for reducing vibrations comprises a controller that is designed to adapt the vibration-reducing properties of the additional apparatus for reducing vibrations on the basis of operating data of the industrial truck.

6. The industrial truck according to claim 1, wherein the outrigger is designed as a rigid rod at least in a portion of the outrigger.

7. The industrial truck according to claim 1, wherein the first fastening point is associated with a counterweight of the industrial truck.

8. The industrial truck according to claim 1, wherein the mast is designed as a mast that is constructed of multiple parts so as to be telescopically extendable.

9. The industrial truck according to claim 1, wherein an additional outrigger is provided, a longitudinal axis of which extends between a third fastening point on the vehicle body and a fourth fastening point on the mast, the fourth fastening point being associated with the vertically upper side of the mast.

10. The industrial truck according to claim 1, wherein the mast is associated with a cab carrier that is movable in a vertical direction.

11. The industrial truck according to claim 1, wherein the industrial truck is designed as a tri-lateral sideloader.

* * * * *